US008393054B2

(12) United States Patent
Bienek

(10) Patent No.: US 8,393,054 B2
(45) Date of Patent: Mar. 12, 2013

(54) DOOR OPERATOR

(75) Inventor: Volker Bienek, Dortmund (DE)

(73) Assignee: Dorma GmbH + Co. KG, Ennepetal (DE)

( * ) Notice: Subject to any disclaimer, the term of this patent is extended or adjusted under 35 U.S.C. 154(b) by 1279 days.

(21) Appl. No.: 11/793,068

(22) PCT Filed: Nov. 11, 2005

(86) PCT No.: PCT/EP2005/012089

§ 371 (c)(1),
(2), (4) Date: Jun. 15, 2007

(87) PCT Pub. No.: WO2006/066661

PCT Pub. Date: Jun. 29, 2006

(65) Prior Publication Data

US 2008/0092446 A1 Apr. 24, 2008

(30) Foreign Application Priority Data

Dec. 17, 2004 (DE) ..... 10 2004 061 622

(51) Int. Cl.
*E05F 1/00* (2006.01)

(52) U.S. Cl. ..... 16/71

(58) Field of Classification Search ..... 16/71, DIG. 7, 16/DIG. 9, DIG. 21; 403/34, 343; 285/19, 285/70

See application file for complete search history.

(56) References Cited

U.S. PATENT DOCUMENTS

| | | | | | |
|---|---|---|---|---|---|
| 1,063,790 | A | * | 6/1913 | Greaves | 403/259 |
| 1,429,982 | A | * | 9/1922 | Tubbs | 403/276 |
| 3,852,846 | A | * | 12/1974 | Slaybaugh | 16/48.5 |
| 4,040,144 | A | * | 8/1977 | Lasier et al. | 16/66 |
| 4,870,961 | A | * | 10/1989 | Barnard | 128/202.27 |
| 5,474,334 | A | * | 12/1995 | Eppink | 285/184 |
| 5,488,896 | A | * | 2/1996 | Current | 92/129 |
| 6,223,469 | B1 | | 5/2001 | Moll | |
| 2004/0168284 | A1 | | 9/2004 | Duffy | |

FOREIGN PATENT DOCUMENTS

| | | |
|---|---|---|
| DE | 197 17 993 | 10/1998 |
| DE | 197 56 496 | 7/1999 |

OTHER PUBLICATIONS

Search Report dated Feb. 8, 2006 for the underlying International Application No. PCT/EP2005/012089.

* cited by examiner

*Primary Examiner* — Victor Batson
*Assistant Examiner* — Matthew Sullivan
(74) *Attorney, Agent, or Firm* — Cozen O'Connor

(57) ABSTRACT

A door operator includes a first component having a right-hand thread, a second component having a left-hand thread, and a plug-in or rotatable coupling having two complementary threads. The first and second compartments are interconnected to each other by the coupling when the right-hand thread of the first compartment and the left-hand thread of the second compartment engage the respective complementary threads of the coupling.

7 Claims, 3 Drawing Sheets

DOOR OPERATOR

CROSS-REFERENCE TO RELATED APPLICATIONS

This is a U.S. national stage of International Application No. PCT/EP2005/012089, filed on Nov. 11, 2005. Priority is claimed on German Application No. 10 2004 061 622.1, filed on Dec. 17, 2004.

BACKGROUND OF THE INVENTION

1. Field of the Invention

The invention relates to a door operator consisting of several components, such as mechanical, hydraulic and electrical drive systems, and/or one or more housings, the components being connected to each other.

2. Description of the Related Art

A swing door operator having an electromechanical drive unit is known from DE 197 56 496 C2. This swing door operator has an open construction without a closed housing, whereby the individual components are affixed one after the other to a cover plate or to a covering, which in turn can be flush-mounted in the door leaf. Thus the gear and the drive motor are flange mounted to the cover plate via a bearing support. If greater torques are required, the exterior dimensions of gear and motor are considerably larger than illustrated in FIG. 1 of DE 197 56 496 C2. The flange connection used therein between the gear and the cover plate requires that there is either enough space outside the diameter of the drive components, or that one of the components, as illustrated in this state-of-the-art, in at least one area, has a smaller diameter than the hole diameter of the flange connection, in order to have enough space for mounting the screw heads and/or nuts. In case there are additional components for a modularly designed drive, e.g. a closer spring with a housing, long drives are created, in which an undesired positional deviation of the axes may lead to a premature failure of the overall drive. Another disadvantage of this state-of-the-art is that a closer spring can not be used as an additional or alternative structural component to the shown components, because the arising forces can not be accommodated by the covering. When using a conventional cast housing, which is usual for door operators, housing lengths are generated which may extend nearly over the overall door length. With the dimensions required for the installation in the door, a complete mounting of the drive components as series fabrication is no longer possible.

DE 197 17 993 A1 describes an automatic door operator, in which several return devices can be modularly connected by means of a coupling.

Door closers are known as well, in which a basic structure can be equipped with different closer springs, in order to achieve various torque curves. For this purpose the closer springs with a spring housing are screwed to the door closer, the spring housing, at the connection side, having a female or male thread, which is screwed into a complementary thread at the door closer housing. When considering the longitudinal axis of the structural components as the axis of rotation for screwing-in the threads, it is impossible to pre-determine exactly in which position the spring housing will bear against the door closer. Here, the problem is that no exact positional disposition is possible, in particular not for the angular disposition at the housings.

SUMMARY OF THE INVENTION

Therefore, an object of the present invention is to provide a door closer comprising at least two components, which, with regard to their positional disposition, can be precisely aligned and interconnected.

This problem is solved in that two components are interconnected to a coupling, one component having a right-hand thread and the other component having a left-hand thread, and in that the right-hand and left-hand threads engage in complementary threads of the coupling. Thereby, once the components are axially aligned to each other, the components can be interlocked by rotating the coupling, without creating neither an axial deviation nor an angular deviation.

Components are meant to be drive systems, such as pump, motor and a hydraulic block, but also in particular housings and housing parts, which are able to accommodate or to be connected to the pump, the motor or the hydraulic block. This way several housings can be interconnected, which will accommodate the pump, the motor or the hydraulic block. However, the pump, motor or hydraulic block can be affixed to one housing as well, which in turn accommodates additional drive systems and drive elements. In this case, hydraulic block designates substantially the structural combination of valves, lines, and/or other hydraulic components.

But also the basic components of a door closer or a door operator, which for example may consist of the cam technology with cam disc and compression rollers or of the piston technology with internally toothed piston and pinion, are understood as components. These basic components may be mounted in their own housing and, depending on the application case, may be combined with other drive components by means of the coupling. Since, depending on the application case, both the cam technology and the piston technology have advantages and disadvantages, the respectively appropriate technology can be combined by means of a uniform structural unit, which integrates the drive motor, hydraulic pump, spring compartment and spring force adjusting device. The coupling constitutes the prerequisite to interconnect the different components, which cooperate trouble-free only with a precise positional disposition.

Instead of the connection via threads, a bayonet catch or another releasable connection type can be used.

According to this solution, the coupling may have the function of a union nut and may be screwed onto the components from outside, or—as an advantage with regard to available space for installation into the door—may be a coupling installed in one—or both—components.

In a preferred embodiment, the right-hand and left-hand threads of the components are a female thread for this purpose, and the complementary threads of the coupling are male threads. Thus, the coupling is screwed into the components.

The following explanation refers to the use of the coupling with at least one housing, which will be connected to another component, such as a hydraulic block, pump or to a second housing part. In this case, in a preferred embodiment, the coupling may have an internal bore and be penetrated by a piston rod, a spring push-rod or a spindle, such that different components having various functions can be interconnected modularly and their functions complement each other.

The coupling is sealed with joints in relation to the piston rod and to the housing, such that a separate pressure compartment can be formed in each housing.

On its frontal side, the coupling may have tenon holes, in which the tenons of a tool engage. Thus, a housing can be completely pre-mounted and the coupling is attached with the second housing. The tool penetrates the second housing and, with its tenons, engages in the tenon holes of the coupling, such that the coupling is rotated by rotating the tool, and the housings move towards each other axially along the threads. By further rotating, the housings are interlocked until the frontal sides tightly abut each other.

In a hydraulic door operator, hydraulic channels are machined into the housings parallel to a longitudinal axis of the housings, which channels are interconnected in true alignment, at the abutting frontal sides of the housings connected by the coupling. Due to the fact that the axial positional and the angular disposition of the housings is precisely guaranteed on account of the coupling connection, the channels and lines, exiting at the frontal sides of the housings, can be sealed towards the outside towards the gap between the housings and can be interconnected at little expense. Another non negligible advantage results from manufacturing these channels and lines, because deep bores are always very expensive in manufacturing and are inaccurate with regard to tolerances. By using several housings or by flange-mounting of hydraulic block or pump, the bores along the longitudinal axis for the hydraulic channels may have a smaller depth, because, through the precise axial, positional disposition and angular disposition, a connection of the channels is possible via the frontal sides of the components without any problem.

Another improvement is achieved, if connectors, which seal off the hydraulic channels to the outside, are inserted into the adjoining open hydraulic channels of the first and second housings. In this case, the connectors simultaneously assume the function of fixing the position of the housings with regard to each other and absorb part of the torques, which arise when the housings are screwed to the coupling.

On account of its compact structure, the inventive door operator allows for a concealed installation within a door profile or a frame profile and thus allows for a total integration with the door system. Particularly the installation in common narrow door profiles is possible.

As an advantage, neither special door profiles nor any special constructions are necessary, which would interfere with the design of the door system. Another advantage results from an economical mounting combined with a wide applicability, and it is moreover possible to retrofit existing door systems with the inventive door operator.

Another advantage resides in the use of various materials for components, which are interconnected via the coupling. A basic housing with the dampening, the cam disc and the drive shaft may be manufactured from cast iron or cast steel and the complementing housing part with the compression spring from aluminium.

Another advantage results from the ease of mounting of the door operators, which only now allow for series fabrication. When using the previous cast housings having an inner diameter of 20 to 50 mm depending on the application case, an efficient mounting of the drive systems with a housing length of 500 to 900 mm is no longer possible, because the labour constant of reaching into this narrow bore with mounting tools is far too important. Thus, a pre-mounting of the structural units outside the housing-halves is possible. The housings can be manufactured with industrial standard machines, making the door operator inexpensive, because no special machines are required and there are far less rejects with the shorter housing parts.

It is likewise possible to design the door operator according to a modular concept with different components.

BRIEF DESCRIPTION OF THE DRAWINGS

Further details, features and advantages of the invention will become apparent from the following description of exemplary embodiments, reference being made to the drawings, in which.

DETAILED DESCRIPTION OF THE PREFERRED EMBODIMENTS

Figure 1:
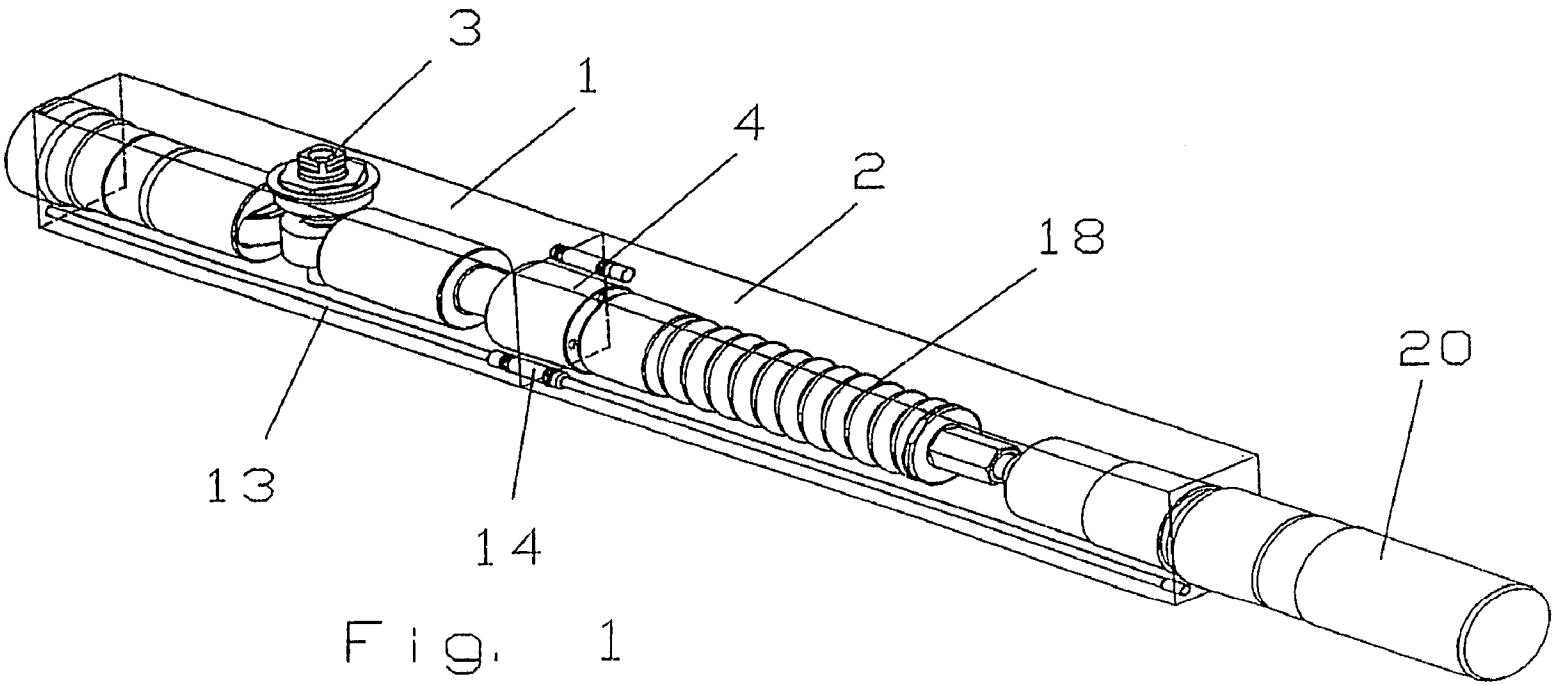
FIG. 1 shows a perspective view of a door operator with a split housing and a coupling.

FIG. 1 shows a door operator consisting of a first housing 1 and a second housing 2, which are interconnected via a coupling 4. The basic components, e.g. cam disc with damping piston, a drive shaft 3, as well as other hydraulic and mechanical structural components, are located in the first housing 1. The door operator is connected to a door frame or to a wall via the drive shaft 3 by means of a lever, not illustrated, via a sliding member and slide channel. As an alternative, depending on the application case, the use of a scissor arm assembly is possible. The second housing 2 accommodates further drive components such as the compression spring 18, hydraulic piston, pump, motor or control device. In this case, it is possible to modularly build the drive from more than two housings, which are then connected to one coupling 4, respectively. Instead of the second housing 2, not illustrated drive systems, such as pump/motor 20 or a hydraulic block, can be flange-mounted. One or more hydraulic channels 13, which are connected and sealed towards the outside via connectors 14, extend parallel to the longitudinal axis 12 of the housings 1, 2.

Figure 2:
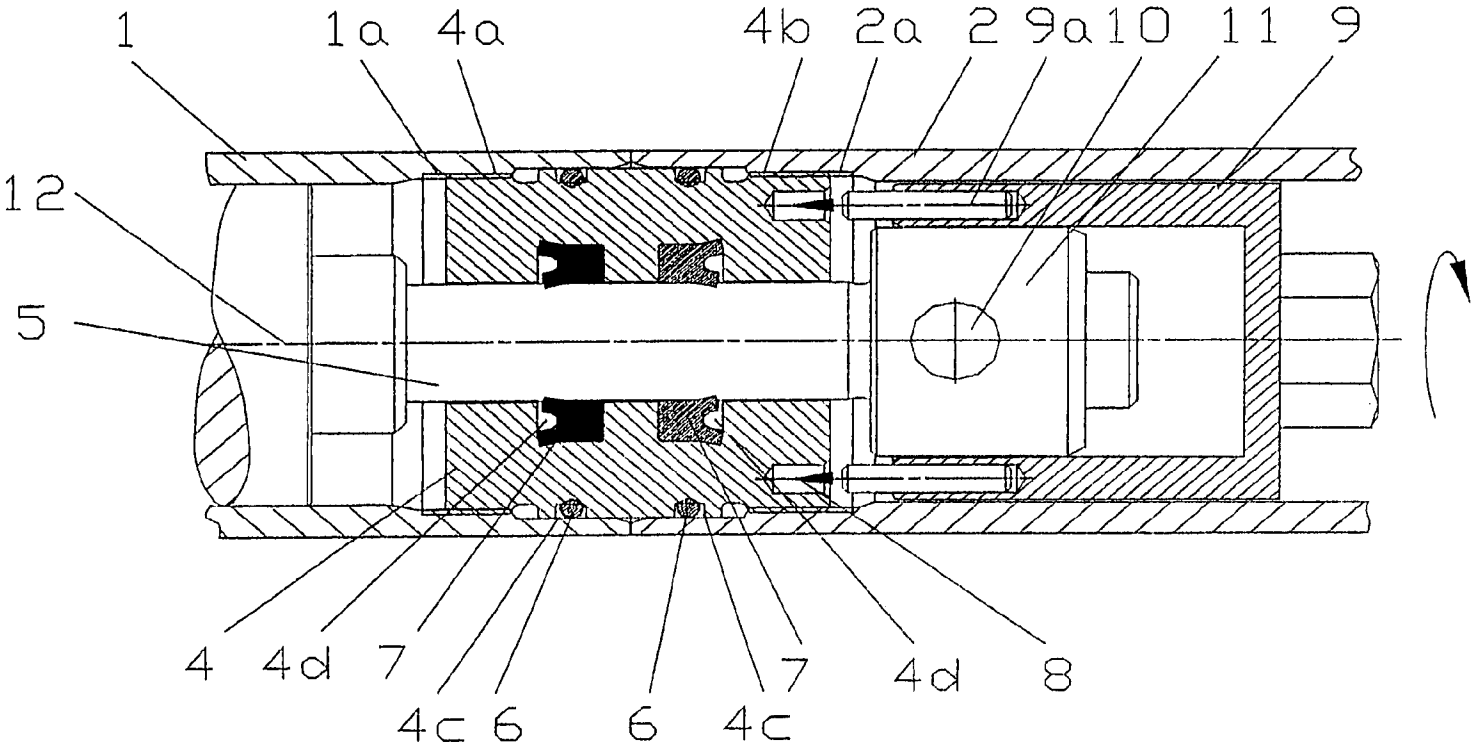
FIG. 2 shows a sectional illustration through the area of the coupling.

In FIG. 2, the first housing 1 has a right-hand thread 1*a* and the second housing 2 has a left-hand thread 2*a*. The right-hand thread 1*a* engages in a complementary right-hand thread 4*a* of the coupling 4, and the left-hand thread 2*a* engages in a likewise complementary left-hand thread 4*b* of the coupling 4. Obviously, the left-hand and right-hand threads are interchangeable, whereby it is of importance that the threads be disposed with an opposite pitch. In this exemplary embodiment, first housing 1, coupling 4 and second housing 2 are penetrated by a piston rod 5. The coupling 4 has sealing grooves 4*d*, wherein the piston rings or sealing rings 7 can be accommodated. Sealing grooves 4*c* are likewise machined into the outside diameter of the coupling 4, in which grooves the sealing rings 6 can be accommodated, such as round or radial sealing rings. This way, the pressure compartments of the housings 1 and 2 can be separated from each other via the coupling 4. In the second housing 2, via a pin 10, the piston rod 5 is connected to a piston coupling 11, against which, via a not illustrated piston, a compression spring bears, likewise not illustrated. Instead of the piston rod 5, a push-rod for a compression spring or a drive spindle can penetrate the housings 1 and 2 as well as the coupling 4. Tenon holes 8, into which the tenons 9*a* of a tool 9 engage, are drilled into a frontal side of the coupling 4. It is useful that the number of the tenons 9*a* or of the tenon holes 8 amounts at least to two, preferably four, which are evenly distributed on a circle about the central axis. Other non-positive power transmission means are likewise possible, such as a hexagon or the like.

A mounting of the housings 1 and 2 is performed as follows: The pre-mounted first housing 1 is stationary positioned. Outside the housings 1, 2, the piston rod 5 with the attached piston coupling 11 is pre-mounted with the pin 10, as well as with the coupling 4 and the sealing rings 6, 7. Then this complete structural unit is inserted in the housing 1 and the connectors 14 are inserted. The housing 2 is slid over the piston rod 5 with the thereto attached piston coupling 11, which projects from the coupling 4, until the threads 1*a*, 2*a* of the housings 1, 2 engage in the threads 4*a*, 4*b* of the coupling 4.

The second housing 2 is axially aligned with regard to the first housing 1 and fixed such that the second housing 2 is able to carry out an axial movement only. A tool 9 having tenons 9*a* is passed through the second housing 2. The tenons 9*a* engage in the tenon holes 8 of the coupling 4. By rotating the tool 9, the coupling 4 will be screwed simultaneous into the right-hand thread 1*a* of the first housing 1 and into the left-hand thread 2*a* of the second housing 2, the positional and angular disposition of the housing 1 and 2 with regard to each other remaining unchanged; but they approach each other along the longitudinal axis 12 by rotating the coupling 4. The coupling 4 is rotated until the frontal sides of the housings 1 and 2 are abutting each other and are interlocked. In this case also, on account of the final fixing through the connectors 14, the position of the housings 1 and 2 with regard to each other remains unchanged.

In particular with hydraulic drives in which the housings have long bores as hydraulic channels, disposed parallel to the longitudinal axis, the exact positioning and the angular position are very important. Long drilled channels tend to deviate from the intended drilling axis; however, with separate housings, the channels can be much shorter and are thus less expensive in manufacturing. The known solutions, i.e. to run hydraulic lines and channels so to speak like a brake hose along the housing in order to avoid the long bores, are impossible to realize with the door operators, which are integral within the door as there is not enough mounting space. With this feature the invention provides for the first time the possibility to interconnect hydraulic door operators having divided or several housings, such that the channels or lines, which are integral with the housing, function like one continuous hydraulic line. On account of the radial sealing of coupling and connector, no frontal nor flat gasket is required.

Figure 3:
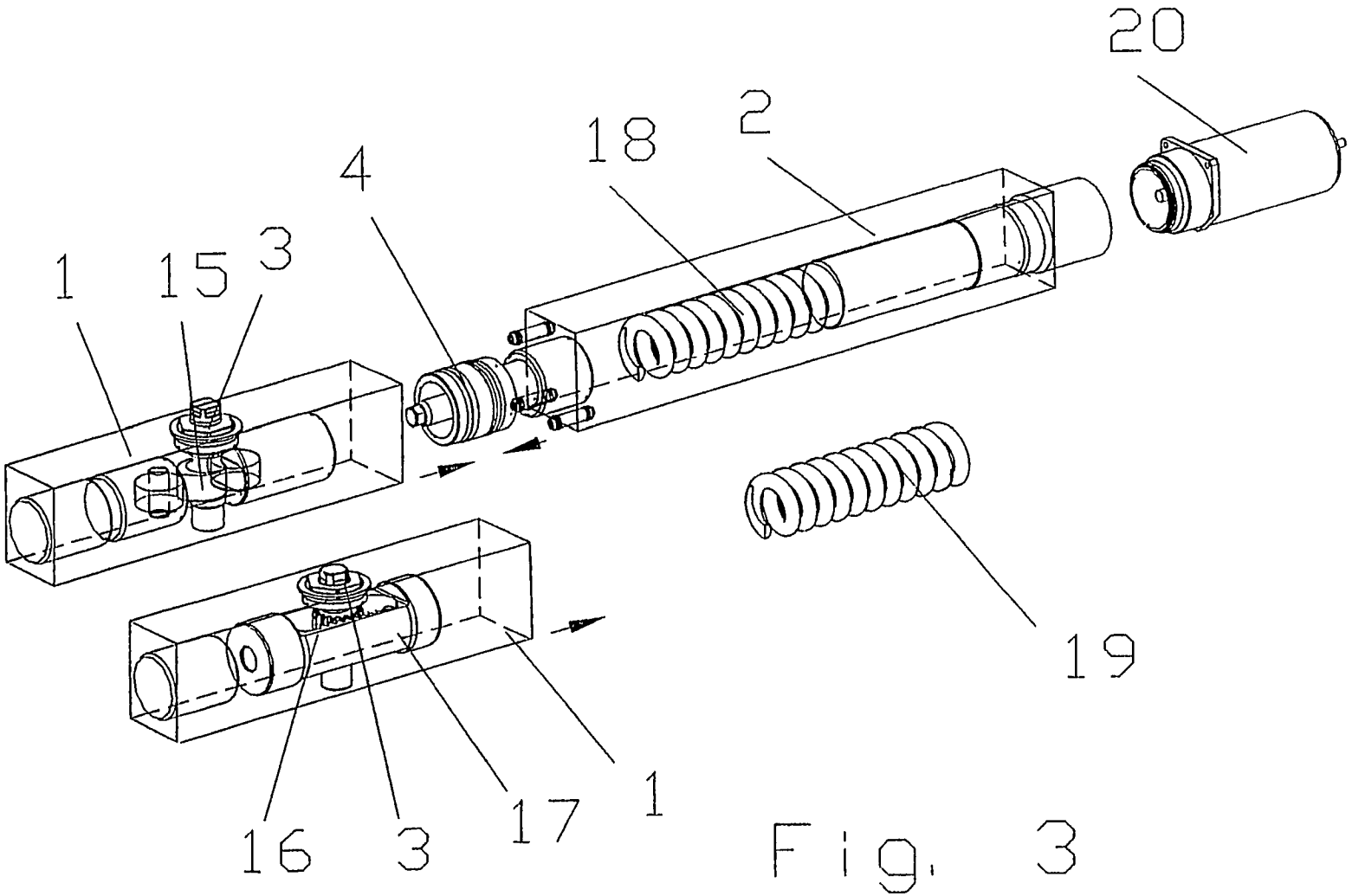
FIG. 3 shows a diagrammatical illustration of a door operator with a modular concept.

FIG. 3 shows a diagrammatic illustration of a modularly designed door operator, in which the second housing 2 accommodates the spring comportment and the spring force adjusting device. The basic components, e.g. cam technology having a cam disc 15 and compression rollers, or piston technology having an internally toothed piston 17 and pinion 16, are integral with the first housing. Depending on the used basic component, matching springs 18 or 19 are installed in the second housing 2. In this case, the first and second housing 1, 2 are connected through the coupling 4. A pump/motor unit 20 with or without hydraulic block can be flange-mounted at the other end of the second housing 2.

What is claimed is:

1. A door operator comprising:

a first component configured as a first housing comprising at least one of a mechanical drive, a hydraulic drive, and an electrical drive, the first component having an end with a right-hand thread;

a second component configured as a second housing comprising at least another one of a mechanical drive, a hydraulic device, and an electrical drive, the second component having an end with a left-hand thread; and a plug-in or rotatable coupling having two complementary threads, the coupling having an axial side and tenon holes on the axial side, each tenon hole configured to be engaged by a tenon of a tool, wherein first and second compartments are interconnected to each other by the coupling when the right-hand thread of the first compartment and the left-hand thread of the second compartment engage the respective complementary threads of the coupling, and wherein when interconnected to each other, the first and second housings have a common longitudinal axis, the door operator further comprises a hydraulic channel extending parallel to the longitudinal axis and through the first and second housings and wherein the first housing comprises a first hydraulic channel and the second housing comprises a second hydraulic channel, the door operator further comprising a connector disposed adjacent to an area where the first and second housings firmly abut each other, the first and second hydraulic channels being interconnected to each other by the connector.

2. The door operator of claim 1, wherein the right-hand thread of the first component and the left-hand thread of the second component are female threads, and the complementary threads of the coupling are male threads.

3. The door operator of claim 1, wherein the first housing is configured to accommodate mechanical elements of a cam drive or a piston drive, and wherein at least one of a spring compartment, a spring force adjusting device, a driving motor and a hydraulic pump is disposed in the second housing.

4. The door operator of claim 1, further comprising one of a piston rod, a spring push-rod and a spindle, the one of a piston rod, a spring push-rod and a spindle penetrating the coupling.

5. The door operator of claim 4, wherein the coupling has a sealing groove and a sealing ring which is disposed in the sealing groove and seals the one of a piston rod, a spring push-rod and a spindle with respect to one of the first and second housings.

6. The door operator of claim 1, wherein the coupling has a sealing groove and a sealing ring which is disposed in the sealing groove and seals the coupling with respect to one of the first and second housings.

7. The door operator of claim 1, wherein the door operator is a hydraulic door operator.

* * * * *